United States Patent [19]

Cerroni

[11] 4,294,413

[45] Oct. 13, 1981

[54] APPARATUS FOR THE BREAKING OF HETEROGENEOUS MATERIALS, AS CITY SOLID WASTES

[76] Inventor: Manlio Cerroni, Via Bruxelles 53, Roma, Italy

[21] Appl. No.: 60,322

[22] Filed: Jul. 25, 1979

[51] Int. Cl.[3] ..... B02C 1/00

[52] U.S. Cl. ..... 241/36; 241/37.5; 241/189 R; 241/263; 241/269; 241/283; 241/DIG. 38

[58] Field of Search ..... 241/264–269, 241/375, 283, 189, 186 R, 190, DIG. 38, 36, 37, 263

[56] References Cited

U.S. PATENT DOCUMENTS 3,891,105 6/1975 Cerroni ..... 241/DIG. 38

*Primary Examiner*—Mark Rosenbaum

*Attorney, Agent, or Firm*—Staas & Halsey

[57] ABSTRACT

An apparatus for breaking heterogeneous material, in particular city solid wastes which are conveyed on a endless belt conveyor (27) which passes underneath the apparatus comprising a plurality of substantially parallel and ordinately closely juxtaposed to each other blades (15) and counterblades (8), this breaking system being supported by a guiding articulated quadrilateral rod system (13, 14, 18) adapted in unison and in sequence to open and raise to close counterblades (8) under the control of hydraulic cylinders (10), while a second auxiliary system (4, 25, 37, 40) provides to raise the first system at the end of the work stroke and to lower it again just before the beginning of its working stroke.

7 Claims, 11 Drawing Figures

FIG.2
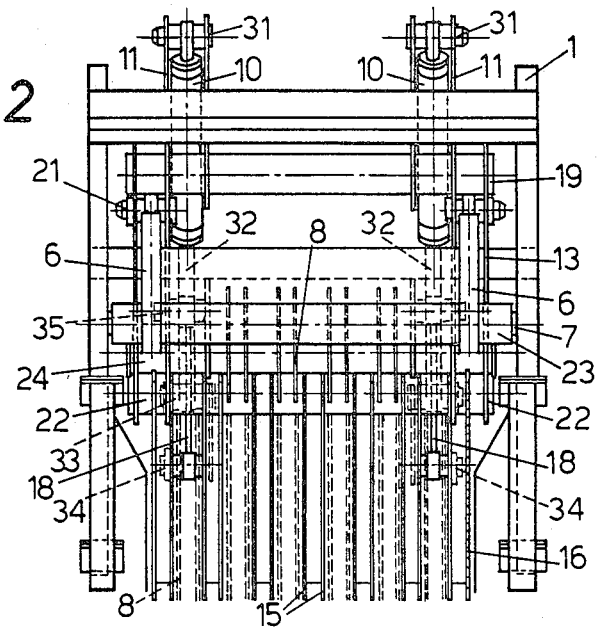
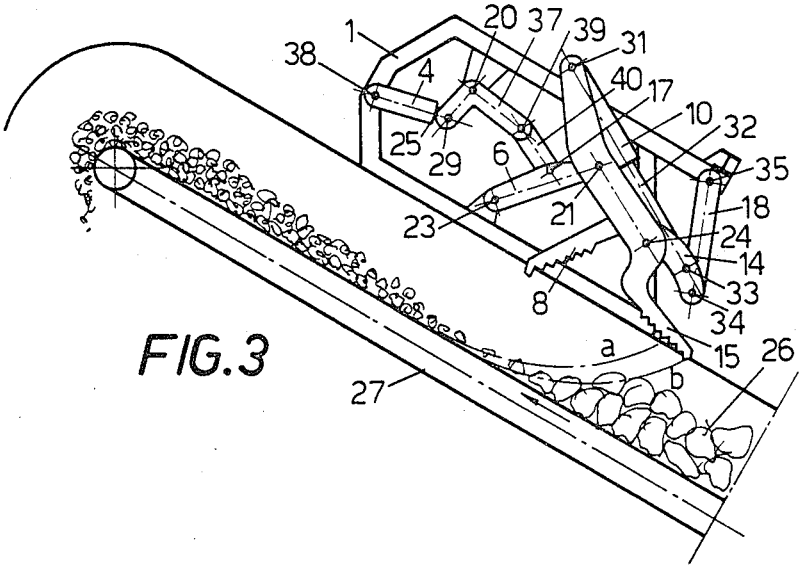
FIG.3

APPARATUS FOR THE BREAKING OF HETEROGENEOUS MATERIALS, AS CITY SOLID WASTES

BACKGROUND AND SUMMARY OF THE INVENTION

The present invention relates to an apparatus and a method for the pre-breaking of city solid wastes without altering the qualities of the components thereof, treatment which precedes the separation of the different materials for the recovery of particular materials contained in the city solid wastes or the like.

Machines are already known which carry out similar operations, but they include crushing mills of a well known type, which are fitted for the treatment of the city solid wastes. These machines operate at high speed and are provided with a rotor, a statoric casing and a plurality of hammers of various configurations keyed on the rotor.

These known machines perform a volumetric reduction of the waste material and therefore also a homogenization of the components of the city solid wastes, but they do not safeguard the specific characteristics of the various materials contained in said city solid wastes. In fact, the violent mechanical action imparted by the rotor and the hammers to the materials does not only reduce the volume of the most encumbering bodies contained in the wastes without altering the smallest bodies, but on the contrary, it acts on all the materials in the same way, forming an intimate mixture thereof.

That makes difficult, and, so to say, nearly impossible, each subsequent separation of the various components for the recovery of the single materials, since on account of such violent mechanical action the various components interpenetrate with each other and are reciprocally contaminated so that they lose their original characteristics. Another inconvenience of the conventional rotating crushers consists in the fact that, due to the violent action thereof, the inner machine members are subjected to a very high wear, so that the utilization becomes nearly impossible in the practice.

There is another negative aspect of these conventional machines which is constituted of the very high energy comsuption thereof.

A last consideration against the use of the crushing mills consists in the fact that they are very expensive to produce.

The present invention provides an apparatus which overcomes the disadvantages of the conventional methods and machines and which comprises a working system including pluralities of juxtaposed blades and counterblades acting as elements of multiblade shears and which operate on the mass of the waste material carried by an endless belt conveyor preforably inclined upwards in the direction of travel, but which could be also horizontal, this belt conveyor conveying the material to be treated to pass underneath the apparatus of this invention.

The two pluralities of juxtaposed blades and counterblades operate, according to a working cycle including a forward and a return stroke, in close juxtaposed relationship to each other up to cross each with the other so as to ensure a complete breaking action on said waste material. Each blade has a considerable thickness in order to have a high strength and for the purpose of allowing the material of small size to pass through the blade and counterblade system, without being subjected to any breaking action. The volume reduction of the biggest bodies forming the waste material takes place by breaking and tearing effects, but never by a cutting action. As a result thereof, the outline or contour of the blades has not much importance and therefore it will not be necessary to maintain said outline in special conditions.

The apparatus is so designed that its two series of blades and counterblades extend through nearly the entire width of the conveyor belt, conveying the waste material and they are provided not only with shears movements, but also with up and down movements, in order that they can be able to grip therebetween the material which advances therebelow, as well as with forward and return movements in the direction of the belt travel and that is necessary in order to prevent, that during the opening phase of the blades and counterblades, these latter do not hit against the material which advances with a constant speed on the belt conveyor. This latter condition is necessary in order to prevent that the advancing material is thrown back, thus causing the formation of piles of material on the belt and giving rise to obstructions in the apparatus.

The aforementioned first two movements are obtained by means of a single hydraulic control system which, taking advantage of a linkage, is able to cause opening and closing movements of the blades and counterblades contemporaneously with up and down displacements.

Owing to the provision of the particular linkage, the blade and counterblade assembly form a rocking unit which will be called "primary hydraulic working system", in which the breaking action and the respective reaction take place entirely inside the frame carrying the blades and the frame carrying the counterblades without transmitting any stress to the carrying structure (frame) which has only the task of supporting the weight of the mechanical elements thereof.

The third movement is controlled by a second hydraulic system which will be called "auxiliary system", comprising a hydraulic cylinder, the piston of which displaces the point that could be named a fixed pivot point of the preceding "primary working system" in the direction of the conveyor belt piston which performs a forward and backward stroke.

The number of the cycles performed by the two systems, which necessarily operate according to a predetermined sequence, can be varied by simply adjusting the oil flow feeding the hydraulic cylinders according to the speed of the waste material which advances on the conveyor belt and according to the desired breaking degree.

The primary hydraulic system controlling the opening and closing movements of the blades and counterblades and their raising and lowering, can be associated with a safety means which, every time the blades and counterblades encounter a particularly too rigid body, causes automatically the reversal of the operating cycle i.e. the beginning of their return stroke so that the blades and counterblades immediately open, releasing the non-breakable object which passes beyond the blades, so that a new operating regular cycle can begin again avoiding damage to said blades and counterblades.

The series of blades consists of blades parallel to each other and aligned in the same plane, but they could be also slightly shifted to each other in order to become operative in close sequence, thus creating a progressive tearing effect of the blades which therefore requires a reduced power. In addition to this, the blades and counterblades are so shaped that their mutual crossing takes place pregressively as in the shears and not frontally. And that is provided for the purpose of reducing the stresses acting on the operating members.

From the foregoing description it results that the wear of the blades and counterblades becomes practically negligible owing to the very low number of cycles in the time unit, as well as on account of the fact that they do not perform a cutting action but only a pressure action which does not require the presence of cutting edges.

In addition to this, the required power becomes only a very small fraction of the power which is normally required when used the conventional crushing mills, on account of the fact that this machine has only the task of treating the biggest bodies, while it has substantially no effect on the waste material of small size which is only pushed forward and which constitutes the greatest percentage of the mixture of wastes.

Other objects and advantages of the invention will be apparent upon consideration of the following description taken in consideration with the accompanying drawings, in which:

BRIEF DESCRIPTION OF THE DRAWINGS

FIG. 2 is the rear end view of the apparatus, with respect of the progress-direction of the waste material;

FIGS. 3 to 7 are the diagrammatic side view of the apparatus showing some of the operative positions of its components;

DESCRIPTION OF THE PREFERRED EMBODIMENT

Figure 1:
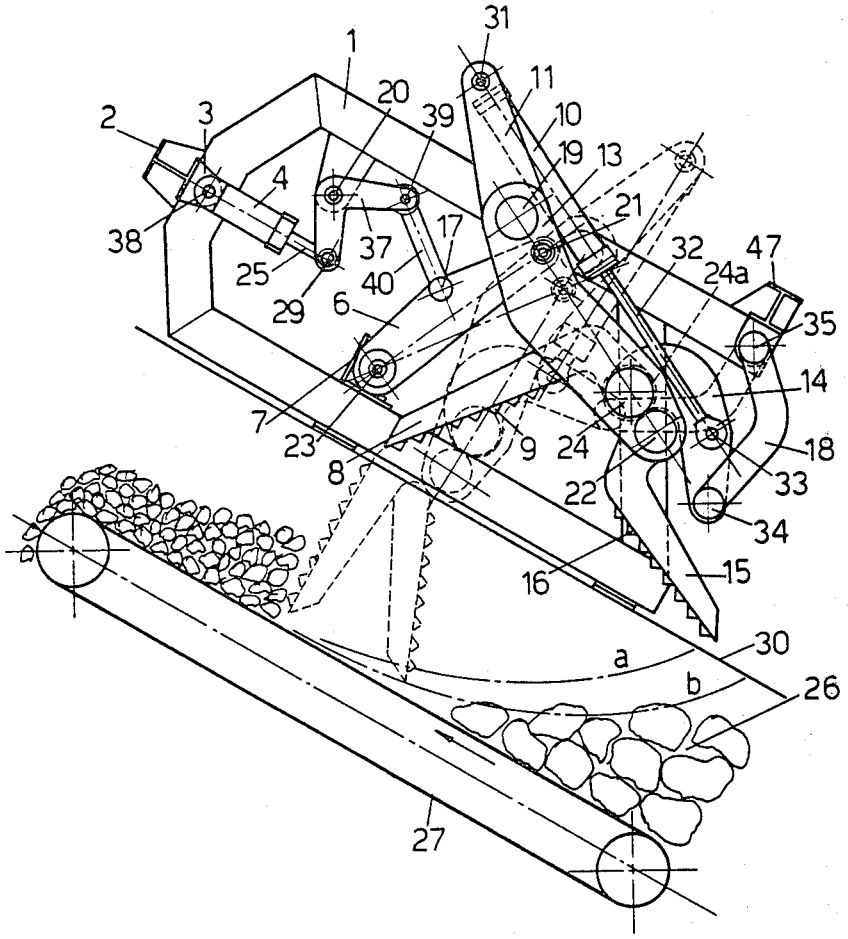
FIG. 1 is a side view of the apparatus when the working elements of the primary working system are inoperative and are positioned as just before the operation of the auxiliary system, while the position of these elements at the end of the operative stroke is shown in broken lines.

Now referring to the shown embodiment, 1 indicates the stationary main support frame of the apparatus mounted on a supporting stationary framework (not shown), and 2 is a upper rear transverse beam carrying a pair of fork-like support members 3 which are articulated by coaxial pivot pins 38 having their axis parallel to that of the beam 2, to two hydraulic cylinders 4 designed to move forwards and backwards the primary system or working unit so as to bring it to a position in which it is enabled to act on the waste material 26, which is caused to advance with a contant but adjustable speed on a belt conveyor 27 of a well known type, the material 26, travelling thereon in the direction of the arrow in FIG. 1, underneath the first working unit.

Into each of the hydraulic cylinders 4 reciprocates a piston (not shown in the drawings) which is connected to a piston rod 25. The piston rods 25 are pivotally connected by the pivot pins 29 to a pair of knee-levers 37 coaxial on pivot pins 20 carried by the stationary frame 1. The two knee-levers 37 are pivotally connected at their other ends, by means of coaxial pivot pins 39, to the connecting rods 40 articulated by coaxial pins 17 to the parallel arms 6, which are made integral one with another by a transverse shaft 23 rotating within supports 7 carried by the frame 1.

The two arms 6, which are made integral one with the other at their other ends are fixed to the coaxial pins 21 about which a rigid structure 13 will be caused to perform rocking movements, the structure 13 at its front end being made integral with a series of parallel blades 15. The rigid structure 13 consists of two suitable shaped side members connected to one another by two stiffening cross tubes 19 and 22. To the stiffening tube 19 two parallel outwardly extending arms 11 are fixedly connected, carrying at their upper portions two coaxial pivot pins 31 to which are articulated the hydraulic cylinders 10 which operate in synchronism.

Along the whole extension of the stiffening tube 22 this latter carries the blades 15 suitable spaced apart from each other and provided with tearing teeth 16.

Besides the two stiffening transverse tubes 19 and 22 the structure 13 also includes a transverse shaft 24 which connects the two side members 13 and as a result thereof allows the structure carrying the counterblades 8 by means the tubular shaft **24*a* rotating about the shaft 24, to rotate around the axis of the shaft 24**.

The counterblades 8 too are distributed along the substantially entire width of the machine and are spaced apart from each other so as to receive the blades 15 therebetween in interlacing relationship.

The counterblades 8 are provided with tearing teeth 9. The structure carrying the counterblades 8 extends frontwards with two strong parallel fork members 14, carrying the pins 33 for the articulation of the piston rods 32 of the hydraulic cylinders 10 as well as the pins 35 for the articulation of the rods 18 which are in turn pivotally connected to the front cross bar 47 made integral with the frame 1. The aforementioned rod or bar system forms an articulated quadrilateral system having as vertices the intersections of the axes of the pins 21, the shaft 24, the pins 34 and the pins 35, with a vertical longitudinal plane of the apparatus and represents diagrammatically the first primary working system designed to perform the opening-closing, raising and lowering movements of the blades 15 and counterblades 8.

The articulated rod system comprising the axes of the pins 38, 29, 20, 30 and 17 constitutes the auxiliary working system having the task of causing the vertex 21 of the first articulated quadrilateral system to move forwards and backwards parallel to the belt conveyor 27. As previously stated, the blades 15 or the counterblades can be respectively parallel to each other and coplanar, or they can be slightly differently inclined in a vertical plane one with respect to the adjacent ones, so as to enable to obtain a less sudden gripping action, on account of a slightly timely deferred action of the pairs of blades and counterblades, so that the blade system takes concave or convex disposition which is symmetrical to the longitudinal vertical center plane of the apparatus. In order to make easier the understanding of the operation of the apparatus, reference is now made to FIG. 8 to which represent diagrammatically the operative components of the primary working system (FIGS. 8 and 9) and those of the primary and auxiliary working system (FIGS. 10 and 11), in their elementary embodiments.

Figure 8:
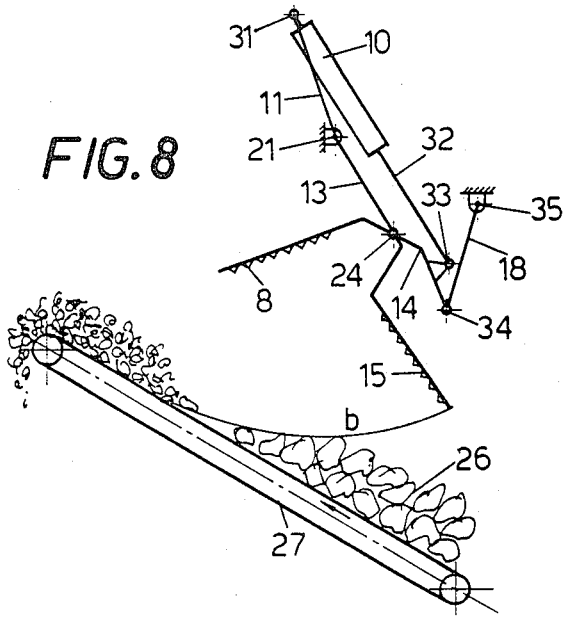
FIGS. 8 and 9 show only the components of the primary working system represented diagrammatically in their positions when the blades and counterblades are in their raised and open limit position and in their lowered closed limit position respectively.
Figure 9:
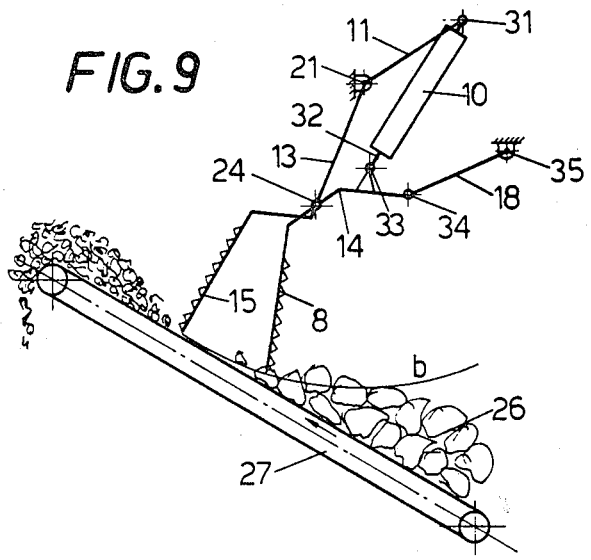

Now, referring to the FIGS. 8 and 9 at first it is assumed that the axis of the pivot 21 be fixed, but on the contrary, according to the complete solution, to said axis is transmitted a forward and backward movement by the auxiliary working system.

As previously stated, the primary working system is constituted of an articulated quadrilateral rod system, the vertices of which are in the points 21, 24, 34 and 35 while the ideal side 21, 35 is stationary.

The side rod 13 connecting the vertices 21 and 24, extends outwardly beyond the vertex 21 with an arm 11, at the end of this latter is pivotally connected the respective hydraulic cylinder 10 by means of the pivot pin 31, while beyond the vertex 24 the rod 13 extends with an arm forming a work blade 15 which diagrammatically represents one of the plurality of blades 15.

The rod 14 defined by the vertices 34 and 24 extends rearwardly beyond the vertex 24 and ends with a counterblades 8 which represents one of the plurality of counterblades 8. The hydraulic cylinder 10 pivotally connected to the pivot pin 31 has its piston rod pivotally connected, to the pivot pin 33 carried by the rod 14.

FIG. 8 shows the position of the parts, when the piston rod 32 of the hydraulic cylinder 10 has reached its outer limit position, i.e. its maximum projection outwardly. When the piston rod 32 moves backwards towards its collapsed limited position, the articulated quadrilateral rod system takes the position shown in FIG. 9, causing the blades and counterblades pairs to cross each other side by side and the contemporaneous lowering of the entire primary working system.

Each blade 15 during this phase rotates about the stationary axis of the pin 21 and the end of each blade 15 travels along the arc b. Each counterblade 8 follows a more complex lowering path, nearly substantially perpendicular to the plane of the conveyor belt 27.

Figure 10:
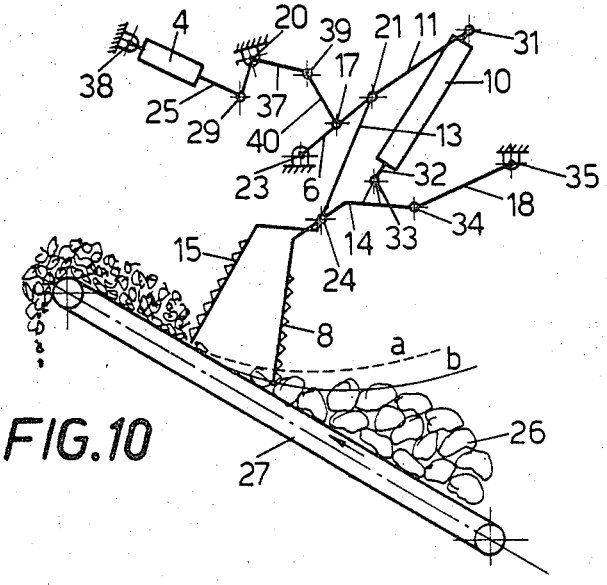
FIGS. 10 and 11 shown diagrammatically the first primary working system, shown in FIGS. 8 and 9, completed with the second auxiliary system in two operative positions of the working cycle.
Figure 11:
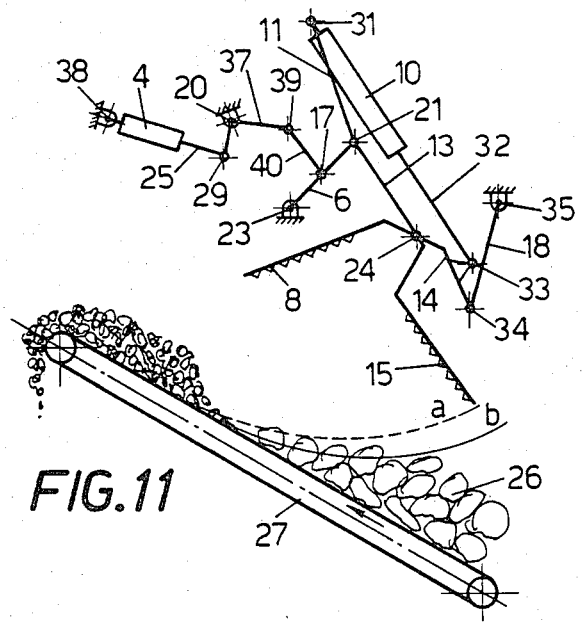

In FIGS. 10 and 11 the primary working system is completed by the auxiliary working system so that the pin 21 is no more stationary but, on the contrary, under the effect of the rod 6 it is forced to rotate about the axis of the pin 23. This rotary movement is such as to impart to the whole primary system a movement forwards and backwards in a direction nearly parallel to the plane of the conveyor belt 27.

FIG. 10 shows the components of the primary working system at the end of a working stroke, in which each blade 15 has travelled along the path b, while the piston rod 25 of the auxiliary system is in its outer limit position, i.e. just before the operation of the hydraulic cylinder 4 for performing the return the piston rod 25 inside of the cylinder 4 and for recalling the primary working system in the progress direction of the waste material on the belt 27, in order that the free end of each blades 15 during its opening stroke can travel along higher path a.

Therefore, owing to the displacement controlled by the auxiliary system the free end of each blade 15 passes from the path b to the path a, so performing the return stroke in a more advanced position with regard of the following material 26.

That has the purpose of insuring that each blade 15 in its return stroke can not impact the incoming waste material and can cause the throw backwards thereof so as to cause the piling up of the material on the belt 27 and therefore, an obstruction in the apparatus.

FIG. 11 shows the position of the parts at the beginning of a working cycle but before beginning the operative stroke of the hydraulic cylinder 4, causing the return stroke of the piston rod 25 and which brings the end of each blade 15 at the beginning of the curve b.

It is to be noted that the auxiliary system, according to the diagrammatic representation of FIGS. 10 and 11 comprises a connecting rod 6, two pivot pins 20 and 38 having stationary axes, a simple connecting rod 40, a knife-lever 37 and an hydraulic cylinder 4 provided with a piston rod 25. The cylinder 4 is articulated at 38, and the fluid operating therein, in particular oil, causes the reciprocation of the piston and of the piston rod 25 thereof. This latter is pivotally connected at 29 to the knife-lever 37, pivotally mounted on the stationary pivot pin 20 and causes this lever to rotate about this pivot pin 20. The knife-lever 37 is connected by the connecting rod 40 to the arm 6 by means of the pivot pin 17 so that it is able to force the pin 21 to move along an arc of a a circumference having the center at 23, and therefore to impart to the primary system a reciprocating movement, substantially in the travel direction of the conveyor belt 27.

The auxiliary system consisting of the aforementioned rod system has also the task of giving a protection to the primary working system, in the event that the hydraulic cylinder 4 could become inefficient. In fact this auxiliary system is also provided to support nearly the entire weight of the apparatus so that it is designed in such a way to be able to carry the whole primary system, in the event that the piston rod 25 of the hydraulic cylinder 4 or other part of this latter breaks. For such a purpose the two levers 37 and 40 are dimensioned and connected 10 as to form a linkage that in the worse condition can take an aligned disposition, without never permitting that the great mass of the apparatus can fall down on the belt conveyor 27 under the effect of the force of gravity, but maintaining it system suspended to the auxiliary system. Of course, this auxiliary system could be performed as a simple hydraulic cylinder, without said safety linkage; in this case the outer end of the piston rod 25 will be pivotally connected directly to the pivot pin 17. Using this solution even if the apparatus is less sure as compared with the foregoing solution, it can yet correctly operate, but in this case other safety means have to be associated therewith.

Figure 4:
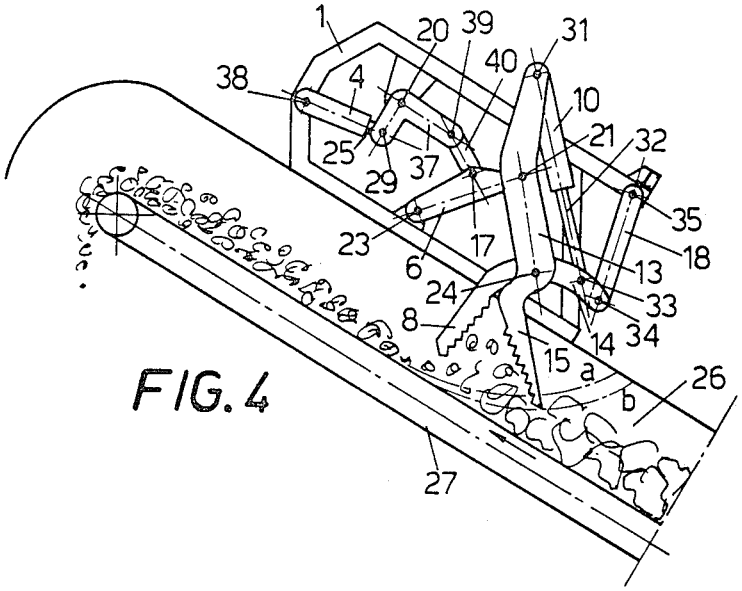
Figure 5:
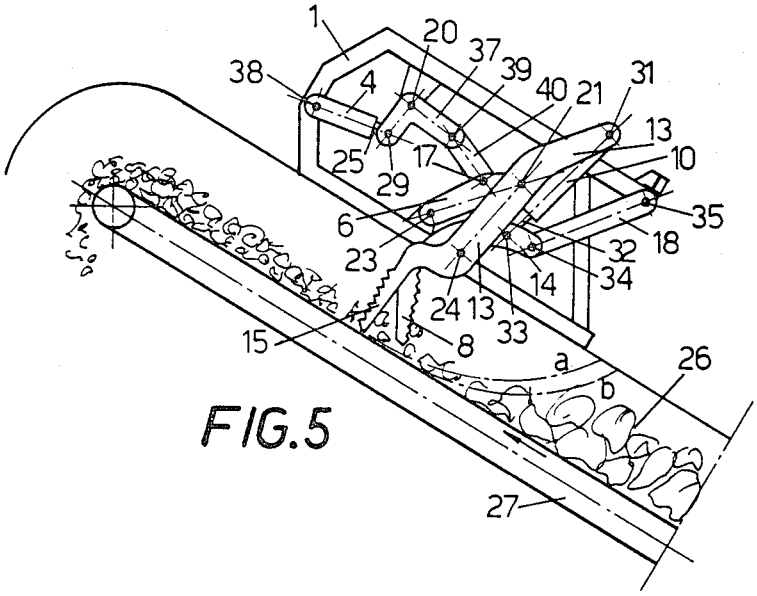
Figure 6:
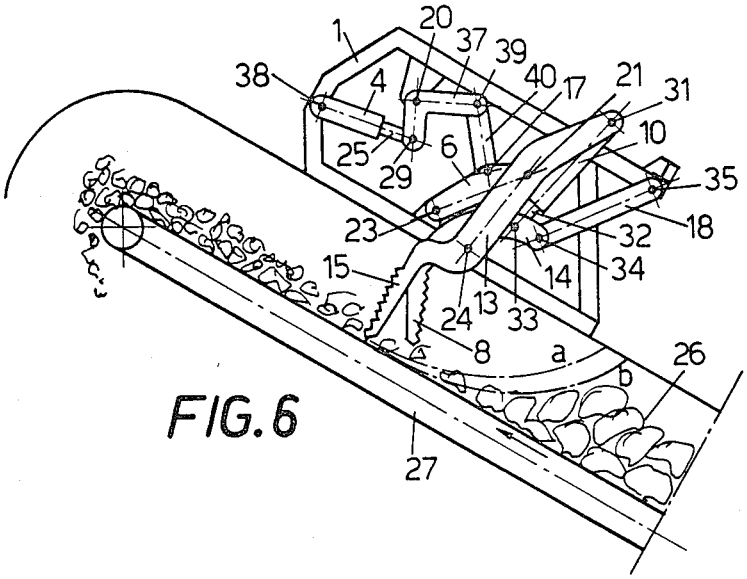
Figure 7:
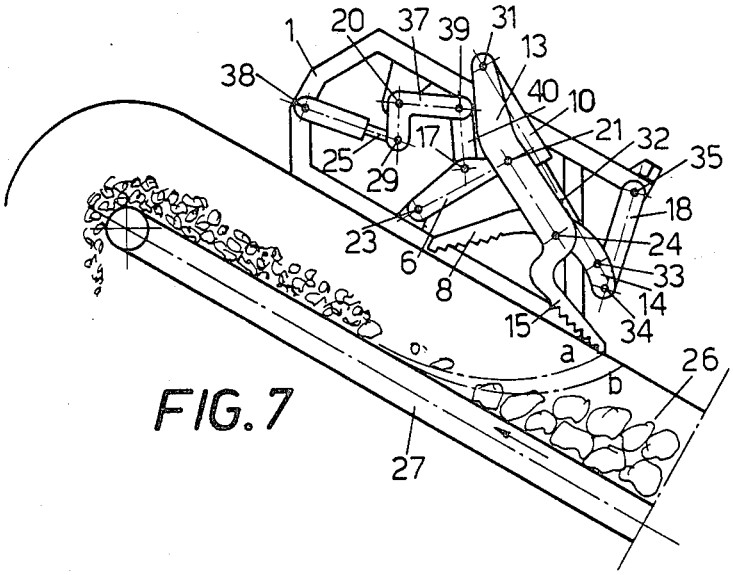

Now, referring to the apparatus shown in FIGS. 1 to 7, it is to be noted that in the preferred practical embodiment it comprises two tridimensional articulated bar system which operate in unison, as the system diagrammatically shown in FIGS. 8 to 11, in its elementary embodiment. FIG. 3 shows the apparatus before the beginning of the working stroke with the piston rod 25 in its retracted limit position. FIG. 4 shows the apparatus in an intermediated position of the working stroke of the blades 15 and counterblades 8, the piston rods 25 being still in their retracted position. FIG. 5 corresponds to the diagrammatic representation of FIG. 10. FIG. 6 shows the position of the parts after the coming out of the piston rods 25 from the respective hydraulic cylinders 4. FIG. 7 shows the parts at the end of the opening stroke of the blades and counterblades 8.

It is to be pointed out that the operative cycle of the apparatus is so controlled that the apparatus performs at least a working stroke on the waste material 26 which at the same time arrives underneath the working unit 15 and 8. The fluid, in particular oil, working in the hydraulic cylinders 10 is fed therein under the control of a pressure sensitive safety device (not shown) adapted to cause the reversal of the stroke, i.e. the beginning of the return stroke in the event that the blades 15 and couterblade 8 engage material having a hardiness non-breakable by them to allow passage of said non-breakable material, avoiding damage to said blades and counterblades.

I claim:

1. An apparatus for the breaking of heterogeneous materials, in particular city solid wastes in which the waste material (26) to the treated is conveyed by an endless belt conveyor (27) travelling at a constant speed, characterized by the fact that the apparatus comprises a first primary working system forming a working unit, including a rigid system of blades (15) and counterblades (8) respectively alternately juxtaposed to each other and mounted so as to rotate about a common axis and controlled in both their opening and closure directions by a guiding rod system forming an articulated quadrilateral system (13, 14, 18), pivotally connected to driving means (10), adapted to cause the articulated rod system to perform each operative stroke at a speed higher than that of the travel of the material (26) on the belt carried by the belt conveyor (27), while a return or closing stroke of the blades (15) and counterblades (8) is performed out of the contact of the waste material (26), owing to a displacement movement transmitted to the first primary system by an auxiliary system, including hydraulic driving means (4), further including means for performing the return stroke immediately, as the counterblades and blades (8 and 15) encounter a resistance higher than a predetermined value.

2. An apparatus according to claim 1, wherein the working unit comprises two series of blades (15) and counterblades (8) carried by a guiding articulated quadrilateral system (13, 14 and 18) suspended, by a pair of axial pivot pins (35), having a stationary axis, to a common support frame (1) overpassing transversely the endless belt conveyor (27), as well as to a pair of coaxial pivot pins (21), the axis of which is parallel to that of the pins (35), the pins (21) being carried by lever arms (7) of an auxiliary system which includes a pair of hydraulic cylinders (4) driven in unison and pivotally connected at (38) to the frame (1), piston rods (25) of the cylinders (4) causing displacement of the axis of the coaxial pins (21), a pair of connecting rods (13) pivotally connected to the pins (21) and being a part of a frame which is made integral with a series of parallel blades (15) mounted and spaced apart from each other on a transverse shaft (22) fixedly connected at its ends to the connecting rods (13), while the pair of connecting rods (14) is made integral with the series of the counterblades (8) parallel to and spaced apart from each other so as to be ordinately close juxtaposed to the series of blades (15), the pair of connecting rods (14) connected by coaxial pivot pins (34) to the pair of connecting rods (18) of the articulated quadrilateral system by means of coaxial pivot pins (35) to the frame (1), whereas a fourth side of the articulated quadrilateral is constituted by an ideal straight line passing through the axes of the pins (21 and 35), means being provided for transmitting movement to the connecting rods (14) of the guiding articulated quadrilateral system.

3. An apparatus according to claim 1, wherein a movable frame (13) carrying the blades (15) and the counterblades (8) ordinately interposed side by side to each other, extends upwards with two pairs of arms (11), outer free ends of which are pivotally connected by coaxial pivot pins (31) to hydraulic cylinders (10) operating in synchronism, the outer ends of the piston rods of the pistons which reciprocate inside the cylinders (10) being pivotally connected by coaxial pivot pins (34) to the pair of lever arms (14) fixedly connected to the tubular shaft **(24*a*) rotatably mounted around the shaft (24) and which supports the series of counterblades (8)**.

4. An apparatus, according to claim 1, wherein the blades (15) and the counterblades (8) have a knife-like form and the facing surfaces of the blades and counterblades in their working position are provided with gripping teeth (16) and (9) respectively.

5. An apparatus, according to claim 1, wherein the blades (15) or the counterblades (8), proceding from sides towards the center of the series of blades or counterblades are slightly advanced or retreated with regard to adjacent ones, so that the series of blades or counterblades assume a concave or convex disposition symmetrically with respect to the vertical longitudinal center plane of the apparatus.

6. An apparatus according to claim 1, wherein the hydraulic cylinders (10) operate under the control of a pressure-sensitive device or pressure switch, designed to cause immediately the beginning of the return stroke i.e. the opening stroke, as the blades (15) and counterblades (8) are subjected to a stress higher than a predetermined value.

7. An apparatus according to claim 1, wherein a device is provided in order to prevent fall down of the working unit in the event that the hydraulic cylinders (4) break, said safety device including a pair of square levers (37) articulated to the free ends of the piston rods (25) of the hydraulic cylinders (4), pivotally connected to the frame (1) by means of coaxial pins (20) and articulated at its other free end in (39) to a pair of connecting rods (40) so as to form a toggle linkage with the arm of the square levers (37) and so dimensioned to be adapted to by aligned to one another and act so as to tension rods as one of the hydraulic cylinders (4) breaks, the connecting rods (40) being articulated by coaxial pins (17) at intermediated points to the arm members (6).

* * * * *